US005148864A

United States Patent [19]

Willis et al.

[11] Patent Number: 5,148,864

[45] Date of Patent: Sep. 22, 1992

[54] HIGH PRESSURE ELECTRICAL CABLE PACKOFF AND METHOD OF MAKING

[75] Inventors: Jürgen A. Willis; Mark A. Metzger, both of Lawrence, Kans.

[73] Assignee: Camco International Inc., Houston, Tex.

[21] Appl. No.: 716,191

[22] Filed: Jun. 17, 1991

[51] Int. Cl.[5] ..... E21B 33/00

[52] U.S. Cl. ..... 166/65.1; 166/88

[58] Field of Search ..... 174/19 X, 65.55, 88 R, 174/65 G; 166/65.1, 66.4, 60, 55.1; 439/191

[56] References Cited

U.S. PATENT DOCUMENTS

| | | | |
|---|---|---|---|
| 3,086,589 | 4/1963 | McGowen, Jr. | 166/65 |
| 3,697,089 | 10/1972 | Jalisin et al. | 174/65.55 |
| 3,739,073 | 6/1973 | Schneider et al. | 174/23 R |
| 3,835,929 | 9/1974 | Suman, Jr. | 166/66.4 |
| 4,154,302 | 5/1979 | Cugini | 166/65.1 |
| 4,288,653 | 9/1981 | Blom et al. | 174/47 |
| 4,288,654 | 9/1981 | Blom et al. | 174/47 |
| 4,303,128 | 12/1981 | Marr, Jr. | 166/302 |
| 4,329,540 | 5/1982 | Howarth | 174/65.55 |
| 4,336,415 | 6/1982 | Walling | 174/47 |
| 4,374,530 | 2/1983 | Walling | 138/110 |
| 4,408,092 | 10/1983 | Eatwell et al. | 174/88 R |
| 4,478,278 | 10/1984 | Klein | 166/105 |
| 4,635,717 | 1/1987 | Jageler | 166/250 |
| 4,725,783 | 2/1988 | Miyairi et al. | 166/65.1 |
| 4,805,698 | 2/1989 | Baugh et al. | 166/272 |
| 4,834,174 | 5/1989 | Vandevier | 166/60 |
| 4,854,886 | 8/1989 | Neuroth | 439/191 |
| 4,877,095 | 10/1989 | Wittrisch | 166/65.1 |
| 4,928,771 | 5/1990 | Vandevier | 166/385 |
| 4,942,764 | 7/1990 | Dews et al. | 174/19 X |
| 5,052,941 | 10/1991 | Hernandez-Marti et al. | 166/65.1 |

*Primary Examiner*—Ramon S. Britts
*Assistant Examiner*—Frank S. Tsay
*Attorney, Agent, or Firm*—Fulbright & Jaworski

[57] ABSTRACT

A high pressure electrical cable packoff and method of making. An integral packoff and seal includes a resin block bound to the insulation of an electrical cable where the metal exterior and jacket have been removed. A resilient sealing ring is molded around and encloses the block and the section of cable where the metal exterior and jacket have been removed. The integral packoff may be used in a wellhead in an oil well for restraining movement of the cable and for forming a high pressure seal.

8 Claims, 2 Drawing Sheets

HIGH PRESSURE ELECTRICAL CABLE PACKOFF AND METHOD OF MAKING

BACKGROUND OF THE INVENTION

The present invention is directed to the provision of a high pressure electrical cable packoff for sealing an electrical cable between two members and in particular to provide a sealed passageway of a production tubing and electrical cable through a wellhead in a well.

It had been previously known to utilize rubber rings which have been compressed in a wellhead in an oilwell for sealing around an electrical cable and the production tubing. However, such seals have not been capable of sealing off against the cable at higher pressures. These prior art designs have resulted in the cable being extruded through the packoff by the differential pressure on the packoff as the force exerted on the cable exceeded the shear strength of the rubber ring.

The present invention is directed to a high pressure electrical cable packoff which is made a permanent part of the electrical cable and capable of sealing around the cable and production tubing at high pressures, such as pressures above 3000 pounds per square inch.

SUMMARY

The present invention is directed to a high pressure electrical cable packoff for sealing an electrical cable between two members in which the cable includes at least one electrical conductor, insulation around the conductor, a jacket around the insulation, and a protective metal exterior. The packoff includes a resin block bonded to a longitudinal section of the insulation where the metal exterior and the jacket have been removed and the block extends outwardly beyond the outside of the cable. A resilient sealing ring is molded around and encloses the block and encloses the longitudinal section of the cable where the metal exterior and the jacket have been removed.

A further object of the present invention is the improvement of a high pressure packoff in an oil well wellhead through which a production tubing and an electrical cable extends in which the packoff is integral with the cable for restraining and sealing when the packoff is compressed in the wellhead. A resin block is bonded to a longitudinal section of the cable where the metal covering and jacket have been removed and extends outwardly beyond the outside of the cable, and a resilient sealing ring is molded around and encloses the block and the longitudinal section of the cable. The ring includes an opening for fitting around the production tubing and a split is provided between the opening and the outer edge of the ring for allowing placement of the ring around the tubing.

Still a further object of the present invention is the provision of a method of making a high pressure electrical cable packoff for an oilwell wellhead in a casing and surrounding a production tubing in which the cable includes at least one electrical conductor, an insulator around each conductor, a jacket around the insulators and a protective metal exterior. The method includes removing the metal exterior and removing the jacket at a longitudinal section of the cable, and bonding a resin block to the insulation where the metal exterior and jacket were removed, and extending the block outwardly beyond the outside of the cable. The method further includes molding a resilient sealing ring around and enclosing the block and the longitudinal section of the cable where the metal exterior and jacket have been removed.

Still a further object of the present invention is wherein a shorter section of the jacket than the metal exterior is removed. That is, more of the metal exterior is removed than the jacket, and the method includes bonding the block and sealing ring to the remaining exposed jacket. The method further includes wherein the resilient sealing ring is bonded to the jacket. Preferably, the block is arcuately shaped for providing a greater support.

A still further object of the present invention is wherein the ring is provided with an opening to accommodate the production tubing and the method includes splitting the ring between the opening and its outer edge to allow placement around the production tubing.

Yet a further object of the present invention is wherein the shorter jacket section allows the jacket to be exposed at both sides of the longitudinal section for bonding to the resin block.

Other and further objects, features and advantages will be apparent from the following description of a presently preferred embodiment of the invention, given for the prupose of disclosure, and taken in conjunction with the accompanying drawings.

DESCRIPTION OF THE PREFERRED EMBODIMENT

While the high pressure packoff of the present invention will be described in connection with its use in a wellhead in an oilwell in an electrical submersible pump oilwell application, for purposes of illustration only, the present packoff may be used in other applications where a leak free seal must be provided around a cable and across a pressure differential.

Figure 1:
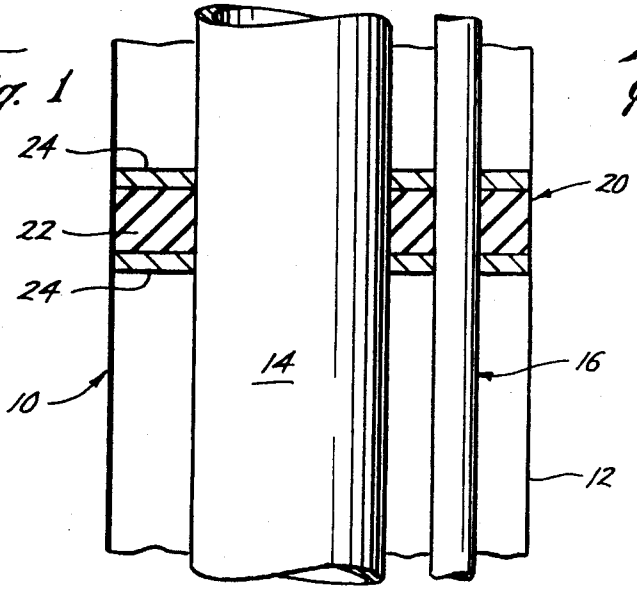
FIG. 1 is an elevational schematic view of the present invention sealing in a wellhead in an oilwell installation.

Referring now to FIG. 1, an oilwell installation is generally indicated by the reference numeral 10 having well casing 12, a production tubing 14 for receiving well fluids, and an electrical cable 16 for driving an electrical submersible pump (not shown) for producing well fluids from the installation 10. A wellhead is generally indicated by the reference numeral 20 and includes a packoff seal 22 which is compressed by members 24 of the wellhead 20 to seal off against the production tubing 14 and the electrical cable 16 and against the inside of the casing 12.

It has been known to utilize rubber compression rings as the packoff 22. However, such rings have not been capable of restraining and sealing off against the electrical cable 16 at higher pressures. That is, a pressure differential exists across the prior art packoff which resulted in the failure of the sealing at the electrical cable 16 and seal 22 interface at higher pressures causing a failure of the packoff.

The present invention is directed to providing a packoff seal 22 which is made a permanent and integral part of the electrical cable 16 and is capable of sealing around the cable 38 and the production tubing 14 at high pressures such as above 3000 pounds per square inch and is capable of restraining the movement of the cable 16 relative to the packoff 22.

Figure 2:
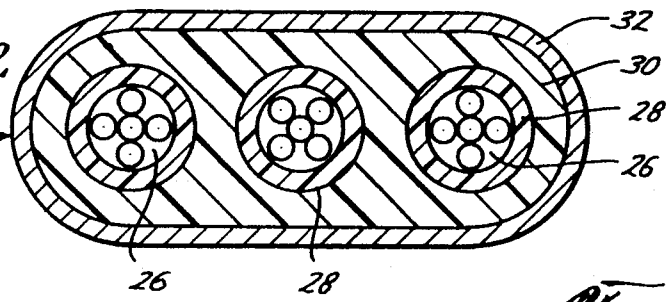
FIG. 2 is an enlarged cross-sectional view of one type of electrical cable that may be used in the present invention.

The present invention can utilize various types of electrical cables, such as round cables, single or multiple conductor cables. One type of cable that may be used is an electrical cable 16, as best shown in FIG. 2, which is a flat three conductor cable. The cable 16 includes three conductors 26 which may be multiple strand copper conductors which are individually insulated with a polymer insulation 28, such as EPDM elastomer, and a polymer or lead jacket 30, such as EPOM, is applied over the insultors 28. The cable is then wrapped with one or more layers of a protective metal exteriors such as conventional protective metal armor 32.

Figure 3:
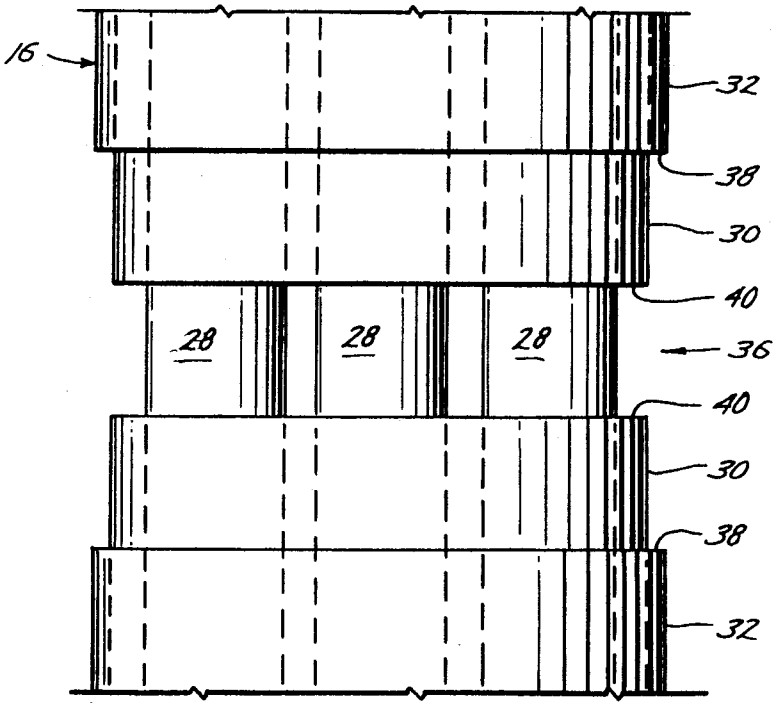
FIG. 3 is an enlarged elevational view illustrating the first step in the method of making the present invention.

Referring now to FIG. 3, the first step in the method of making the packoff 22 of the present invention is best seen. At the longitudinal section, generally indicated by the reference numeral 36, where the packoff is to be made, a section of the protective metal armor 32 is removed, leaving armor ends 38. Also, a section of the jacket 30 is removed, leaving jacket ends 40. Preferably, a shorter section of the jacket 30 is removed than the protective metal armor 32. As best seen in FIG. 3, this step leaves the electrical conductors 26 and their insulators 28 exposed.

Figure 4:
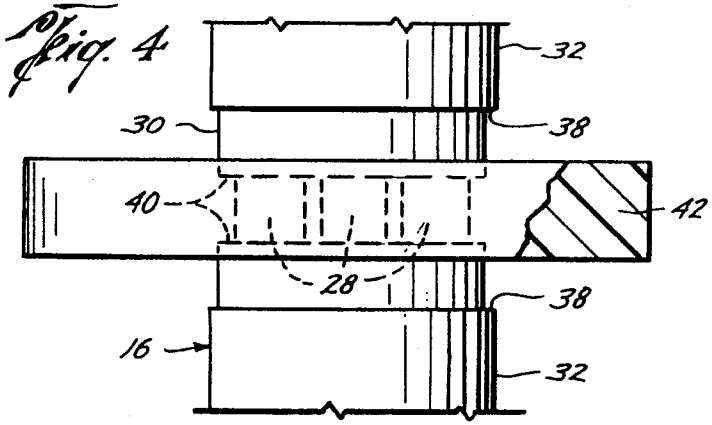
FIG. 4 is a smaller scale elevational view showing a further step in manufacturing the packoff of the present invention.

Referring to FIG. 4, a resin 42 is bonded and completely fills the space around and between the exposed insulators 28, and extends beyond the outside of the cable 16. Preferably, the resin is also bonded to both of the ends 40 of the jacket 30. The resin 42 may be any suitable thermal setting resin such as epoxy or any suitable thermoplastic resin such as polyetheretherketone, and is preferably an epoxy block. The function of the epoxy resin block 42 is to bond to the insulators 28 of the conductors 26, and to the ends 40 of the jacket 30 to distribute the forces created when a pressure differential is applied thereacross. The use of a non-conductive epoxy also prevents electrical stresses which might exist with the use of any type of metal support. Another advantage of bonding the resin 42 to the insulators 28 and jacket 30 instead of to the outside of the metal armor 16 is to prevent the migration of fluids or gases through the electrical conductor 16.

Figure 5:
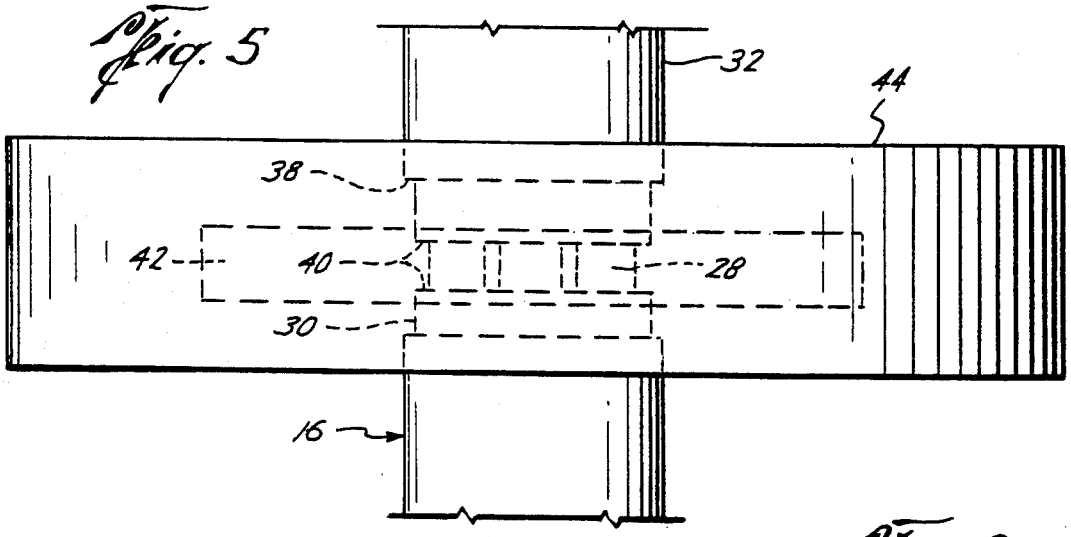
FIG. 5 is an elevational view illustrating a still further step in the manufacture of the packoff of the present invention.

Referring now to FIG. 5, a resilient sealing ring 44, such as rubber, is molded around the resin block 42, and longitudinal section 36 of the cable 16 to enclose the ends 38 of the protective armor 32. Preferably, the electrical cable 16 is treated with an adhesive, such as Chemlok 250, prior to molding of the resilient ring 44. Preferably, the rubber is EPDM or nitrile type.

Figure 6:
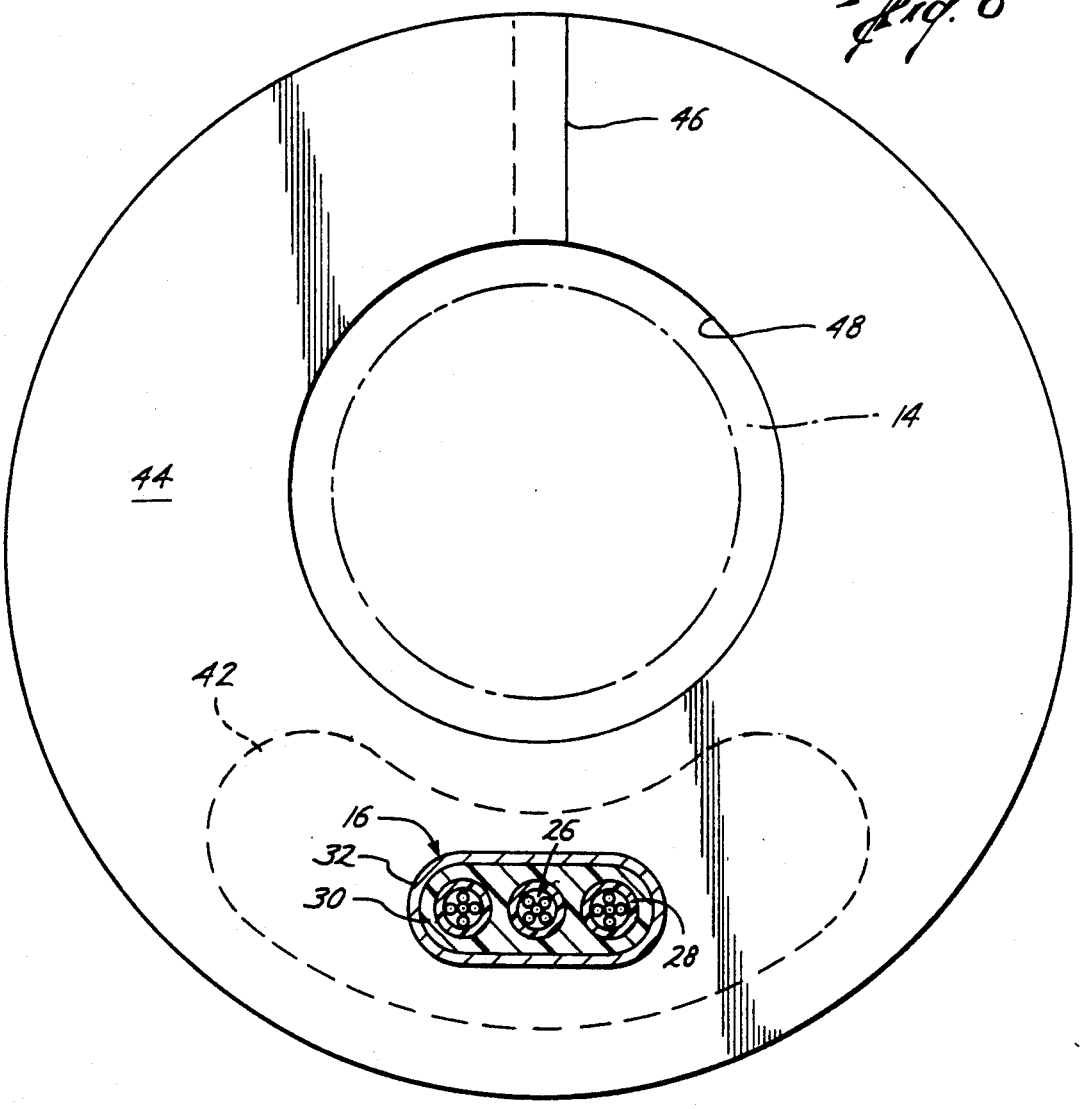
FIG. 6 is an elevational view of the finished packoff in position in a wellhead.

As best seen in FIG. 6, the resin block 42 is preferably arcuately shaped for providing a greater support area in the resilient ring 44. In addition, the ring 44 is split at 46 to provide a split, extending from an opening 48, which accommodates the production tubing 14, to the outside edge of the ring 44. Therefore, the split 46 allows the ring 44 to be placed around the production tubing 14. The entire assembly is then placed in a conventional wellhead connector 20 which normally utilizes two members 24, which are shaped to match the top and bottom of the ring 44. When these plates are actuated to apply a compressive force perpendicularly to the top and bottom of the ring 44, the ring 44 compresses forming a seal around the production tubing 14, the cable 16, and against the casing 12. The ends of the cables 16 are attached to cable in the well and on the surface through standard splicing techniques. In particular, the resin block 42 functions to distribute the forces created by the pressure differential between the well side of the seal 22 (the bottom of the cable 16), and the surface side of the seal 22 (the top half of the cable 16). This distribution of forces reduces local stresses in the cable 16 and at the interface between the cable 16 and the rubber ring 44 which in prior art devices was enough to cause failure of the packoff.

The present invention, therefore, is well adapted to carry out the objects and attain the ends and advantages mentioned as well as others inherent therein. While a presently preferred embodiment of the invention has been given for the purpose of disclosure, numerous changes in the details of construction, and steps of the method, will be readily apparent to those skilled in the art and which are encompassed within the spirit of the invention, and the scope of the appended claims.

What is claimed is:

1. A high pressure electrical cable packoff for sealing an electrical cable between two members in which the cable includes at least one electrical conductor, insulation around the conductor, a jacket around the insulation and a protective metal exterior comprising, a resin block bonded to a longitudinal section of the insulation where the metal exterior and the jacket have been removed and extending outwardly beyond the outside of the cable, and a resilient sealing ring molded around and enclosing the block and enclosing the longitudinal section of the cable where the metal exterior and the jacket have been removed.

2. A method of making a high pressure electrical cable packoff for an oilwell wellhead in a casing and surrounding a production tubing in which the cable includes at least one electrical conductor, an insulator around each conductor, a jacket around the insulators, and a protective metal exterior comprising, at a longitudinal section of the cable removing the metal exterior and removing the jacket, bonding a resin block to the insulation where the metal exterior and jacket were removed and extending the block outwardly beyond the outside of the cable, and molding a resilient sealing ring around and enclosing the block and the longitudinal section of the cable where the metal exterior and jacket have been removed.

3. The method of claim 2 wherein a shorter section of the jacket than the metal exterior is removed, and bonding the block and sealing ring to the jacket.

4. The method of claim 3 including, providing an opening in the ring to accommodate the production tubing, and splitting the ring between the opening and its outer edge to allow placement around the production tubing.

5. The method of claim 3 wherein the resilient sealing ring is bonded to the insulator and to the jacket.

6. The method of claim 4 wherein the block is arcuately shaped for providing greater support.

7. The method of claim 3 wherein said shorter jacket section allows the jacket to be exposed at both sides of the longitudinal section.

8. In an oilwell wellhead in a well through which a production tubing and an electrical cable extends, said cable including at least one conductor, insulation around each conductor, a jacket around the insulation, and a protective metal covering around the jacket, the improvement in a high pressure packoff for restraining and sealing when the packoff is compressed in the wellhead comprising, a resin block bonded to a longitudinal section of cable where the metal covering and jacket has been removed and extending outwardly beyond the outside of the cable, a resilient sealing ring molded around and enclosing the block and the longitudinal section of the cable where the metal covering and the jacket have been removed, said ring including an opening for fitting around the production tubing and a split between the opening and the outer edge of the ring for allowing placement of the ring around the tubing.

* * * * *